United States Patent [19]

D'Andrade et al.

[11] Patent Number: 4,696,655

[45] Date of Patent: Sep. 29, 1987

[54] TOY VEHICLE WITH ADJUSTABLE SUSPENSION SYSTEM

[76] Inventors: Bruce M. D'Andrade, 3 Ten Eyck Rd., Whitehouse Station, N.J. 08889; Joseph A. Marino, P.O. Box 306, South Ryland Rd., Whitehouse, N.J. 08888

[21] Appl. No.: 896,645

[22] Filed: Aug. 15, 1986

[51] Int. Cl.[4] ..... A63H 3/20; A63H 17/26

[52] U.S. Cl. ..... 446/330; 446/385; 446/466; 446/469

[58] Field of Search ..... 441/330, 385, 390, 466, 441/469, 454

[56] References Cited

U.S. PATENT DOCUMENTS

| | | | |
|---|---|---|---|
| 3,144,731 | 8/1964 | Jones et al. | 446/466 |
| 3,409,224 | 11/1968 | Harp et al. | 239/33 |
| 3,645,038 | 2/1972 | Morrison et al. | 446/385 X |
| 3,908,704 | 9/1975 | Clement et al. | 138/21 |
| 4,508,516 | 4/1985 | D'Andrade et al. | 446/454 X |

*Primary Examiner*—Philip C. Kannan
*Attorney, Agent, or Firm*—Kenneth P. Glynn

[57] ABSTRACT

The present invention involves a toy vehicle which includes a body, at least three wheels, wheel support means and a suspension system. The wheel support means connects the body and the wheels in conjunction with the suspension system such that the body may be raised or lowered merely by pulling or pushing on the wheels away from or toward the underside of the body. The suspension system utilizes hollow plastic tubes which include a flexible zone with a plurality of circumferential corrugations which enable the tube to be stretched to sequential lengths until the corrugations assume a longitudinally spaced position. The toy vehicle of the present invention may have as part of its suspension system a single tube as described, or a plurality of tubes, such as one for each of the two front wheels or one for the front wheels and one for the back wheels, or any other combination which may be functionally possible. At least two tubes is preferred.

15 Claims, 8 Drawing Figures

TOY VEHICLE WITH ADJUSTABLE SUSPENSION SYSTEM

BACKGROUND OF THE INVENTION

1. Field of the Invention

The present invention is directed to toy vehicles, including normally operated "push" type toys and motorized toys, and, more particularly, to toy vehicles having an adjustable suspension system which incorporates corrugated snap tubing to permit selected, sequential adjustment of vehicle heights.

2. Prior Art Statement

The toy industry generates a voluminous array of toy vehicles annually, including toy motorcycles, cars, trucks, racing vehicles, three wheelers, tanks, pick-ups, military and space vehicles, construction vehicles and the like. The trend has been to "imitate" real vehicles or to create futuristic toys which capture the imagination. Most recently, toy vehicles have imitated extra large wheel-four wheel drive vehicles and other varied vehicles, including "jacked-up" pick-up trucks, all-terrain four wheelers, etc.

The present invention is directed basically to toy vehicles which can be "jacked up" to selected raised levels and then converted back to normal using an adjustable suspension system. There is no prior art known to the inventors which teaches or renders obvious the present invention toys which are capable of being rear end jacked up, front end jacked up, or both, at selected heights, and then "transformed" back into street vehicles using an adjustable suspension system which incorporates corrugated snap tubes to effect the adjustments.

U.S. Pat. No. 3,409,224 issued to H. J. Harp et al. on Nov. 5, 1968 and U.S. Pat. No. 3,908,704 issued to I. T. Clement et al. on Sept. 30, 1975 are exemplary of prior art patents which teach the basic corregated snap tube technology and are incorporated herein by reference in their entireties (corrugated snap tube is used to mean plastic tubing which is extendable and contractible as well as capable of being bent or angled by virtue of corrugations of the type set forth in these two cited prior art references).

SUMMARY OF THE INVENTION

The present invention is directed to a toy vehicle with a body, at least two wheels, wheel support means and a suspension system. The wheel support means connects the body and the wheels in conjunction with the suspension system such that the body may be raised or lowered merely by pulling or pushing on the wheels away from or toward the underside of the body. The suspension system utilizes hollow plastic tubes which include a flexible zone with a plurality of circumferential corrugations which enable the tube to be stretched to sequential lengths until the corrugations assume a longitudinally spaced position. The toy vehicle of the present invention may have as part of its suspension system a single tube as described, or a plurality of tubes, such as one for each of the two wheels of a motocycle, or in the case of a four wheel vehicle, one for each of the two front wheels or one for the front wheels and one for the back wheels, or any other combination which may be functionally possible.

BRIEF DESCRIPTION OF THE DRAWINGS

The present invention will be more fully understood in light of the specification and drawings, wherein.

DETAILED DESCRIPTION OF THE PRESENT INVENTION

Figure 1:
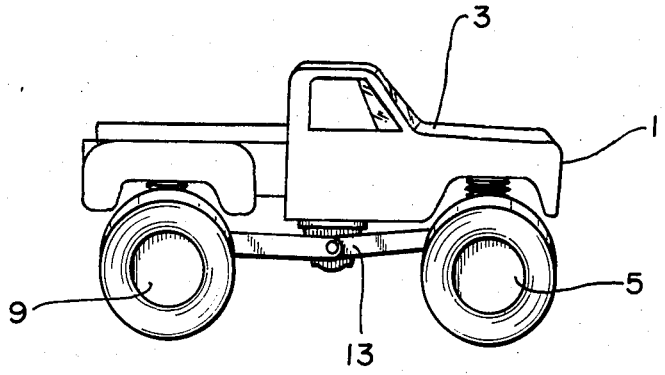
FIG. 1 represents a preferred embodiment of the present invention toy vehicle which includes an adjustable suspension system which permits the front wheels and also the rear wheels to be independently adjusted.
Figure 2:
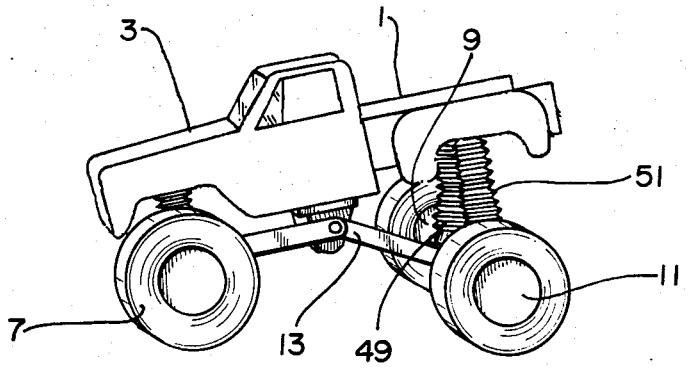
FIG. 2 shows a left side view of the present invention toy vehicle showing FIG. 1 and also shows the rear wheels adjusted to the extended position.
Figure 3:
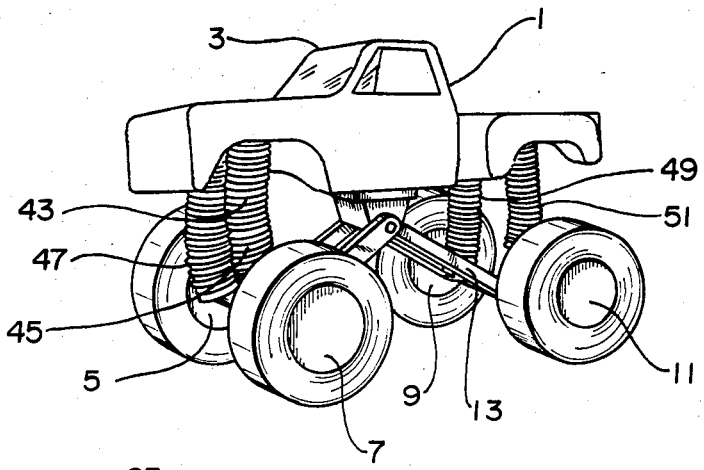
FIG. 3 shows a left side view of the toy vehicle of the present invention shown in FIGS. 1 and 2, but illustrates both the front wheel and the rear wheels as being in the fully extended position.

FIGS. 1, 2, 3, 4 and 5 show various views and portions of a preferred embodiment toy vehicle of the present invention. Like parts are like numbered throughout these Figures. Toy vehicle 1 includes vehicular-type body 3 and has two front wheels, 5 and 7, and two rear wheels, 9 and 11. Although this particular toy vehicle 1 has four wheels, it should be clear that the invention may be a three wheel vehicle or it may have four or more than four wheels and still fall within the purview of the present invention. Also shown is wheel support means 13 which includes a front section 15 and a rear section 17 as most clearly illustrated in FIGS. 4 and 5. Front portion 15 and rear portion 17 each form the sides, top and bottom of a trapezoid and, togetherform an "X" type wheel support means.

Figure 4:
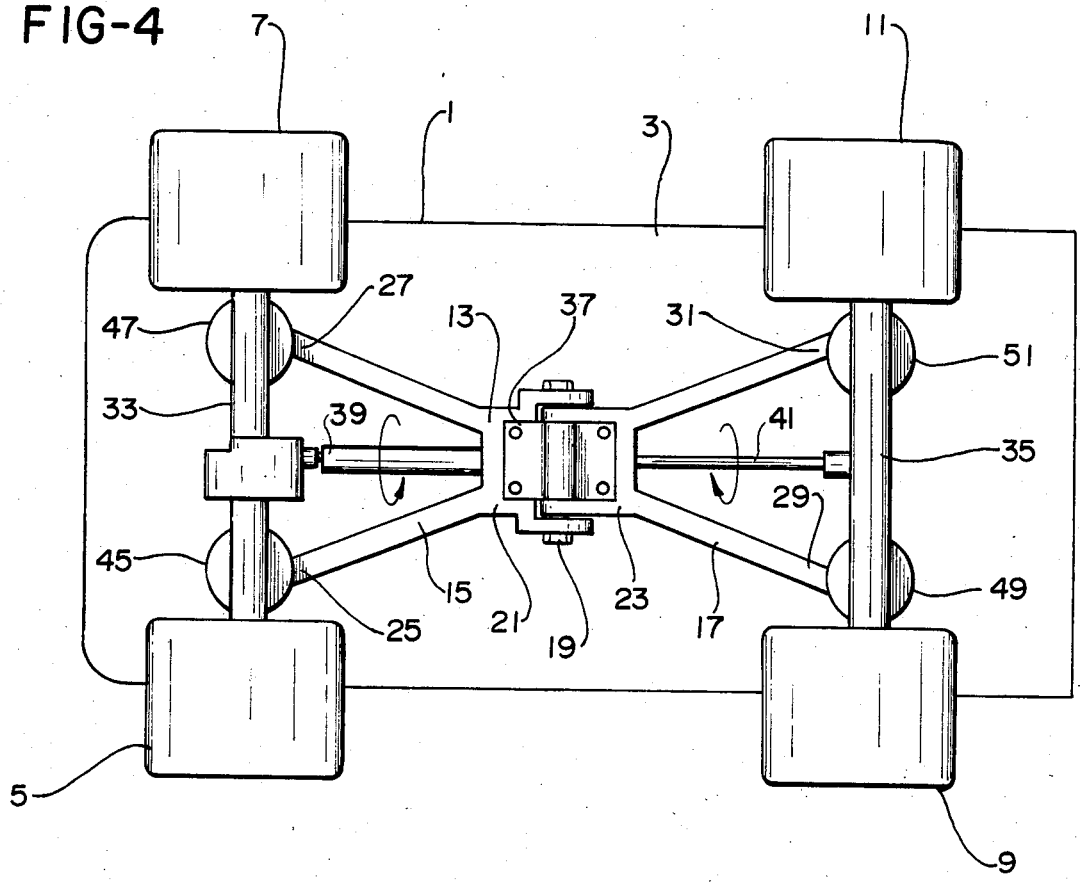
FIG. 4 shows the bottom view of the toy vehicle shown in FIGS. 1 through 3, thereby illustrating the suspension system which includes four of the corregated snap tube type shock absorbers, two for the front wheels and two for the rear wheels, the front wheels and the rear wheels being independently adjustable.
Figure 5:
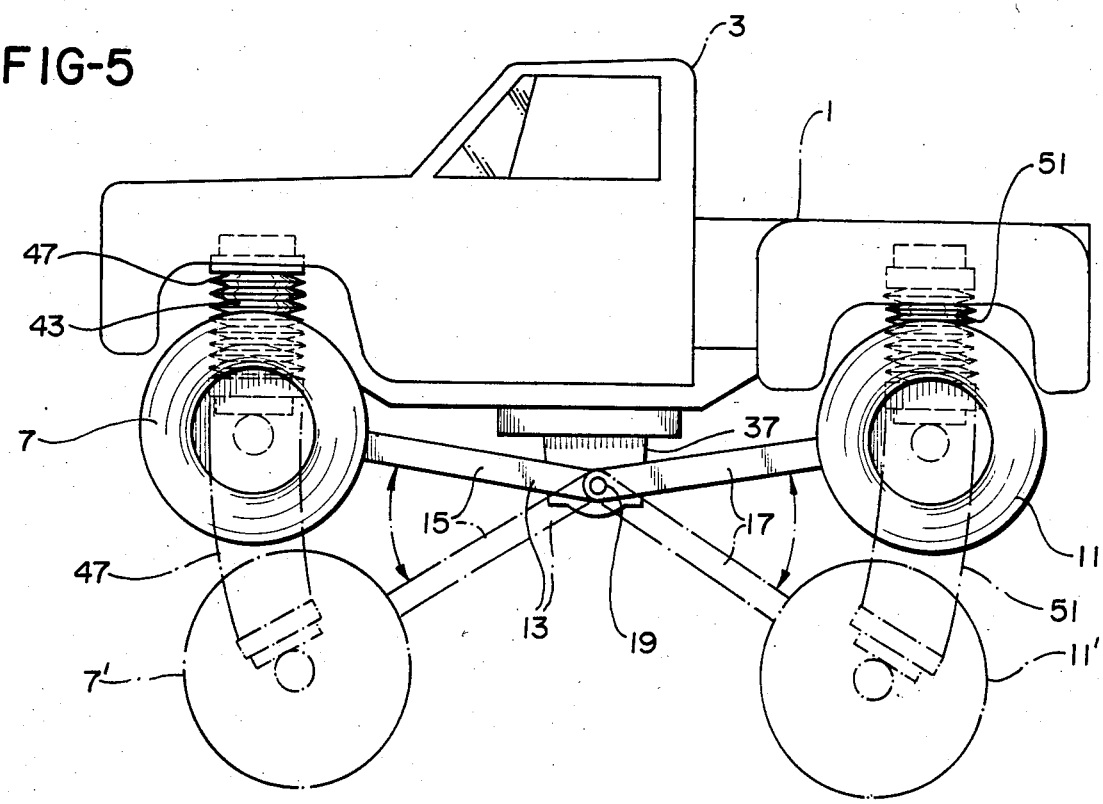
FIG. 5 shows a left side schematic view of the toy vehicle of the present invention shown in FIGS. 1 through 4.

Referring now more specifically to FIG. 4, wheel support means 13 is assembled so as to have front portion 15 and rear portion 17 each independently rotatable about pin 19. Thus, front portion 15 and rear portion 17 each have an upper end, 21 and 23 respectively which are connected to body 3 via pin 19. Additionally, both front portion 15 and rear portion 17 respectively have lower ends 25 and 27, and 29 and 31, which are connected to wheels 5, 7, 9 and 11, respectively, via axle shafts 33 and 35, each of which are integral parts of wheel support means 13. Also shown in FIG. 4 and FIG. 5 is motor encasement 37 with battery operated motor and gear mechanism of conventional arrangement (not shown). While this particular embodiment involves motorization for both front wheel and rear wheel drive via drive shafts 39 and 41, it should be noted that either front wheel or rear wheel drive alone could be employed, or, in the alternative, the toy vehicle of the present invention could simply be a push toy for manual operation. The particular type of motor and its function is within the capabilities of one of ordinary skill in the art and is not a detailed present invention.

Also shown in FIGS. 1 through 5 is suspension system 43 which, in this embodiment, constitutes hollow tube "shocks" 45, 47, 49 and 51.

Referring again to the suspension system 43 which includes four hollow tube "shocks" 45, 47, 49 and 51 (hereinafter referred to as tubes 45, 47, 49 and 51), these tubes are made of thermoplastic material and have a flexible zone intermediate their ends. The flexible zone has a plurality of circumferential corrugations extending along its length and having a close-packed position in which they adjoin, each hollow tube being strechable to sequential lengths until the corrugations assume a longitudinally spaced position. The wall thickness throughout the corrugations is substantially uniform with the corrugations having sidewalls, one of which is long and the other of which is short relative to one another. Both the long walls and the short walls extend at an acute angle with respect to the axis of the hollow tube and this is more fully described and illustrated in U.S. Pat. Nos. 3,908,704 and 3,409,224, incorporated herein by reference above. Thus, the hollow tubes used in any of the embodiments of the present invention may be of any of the types described in those patents incorporated herein by reference.

Referring again to FIGS. 1 through 5, it should be noted that the hollow tubes 45, 47, 49 and 51 are connected to the body 3 of toy vehicle 1 at their upper ends, and that their lower ends are connected to the wheel support means 13. FIG. 5 illustrates the left side view of toy vehicle 1, showing wheels 7 and 11 as well as 7' and 11' being in the original position close to the body 3 of toy vehicle 1 and in the extended position away from body 3.

While this embodiment shows a symmetrical arrangement, a non-symmetrical arrangement of shocks and/or wheel support means could be used. For example, instead of the wheel support means hinging at the center of the underside of the vehicle, the hinges could be located closer to or further from the wheels, as may be desired.

Figure 6:
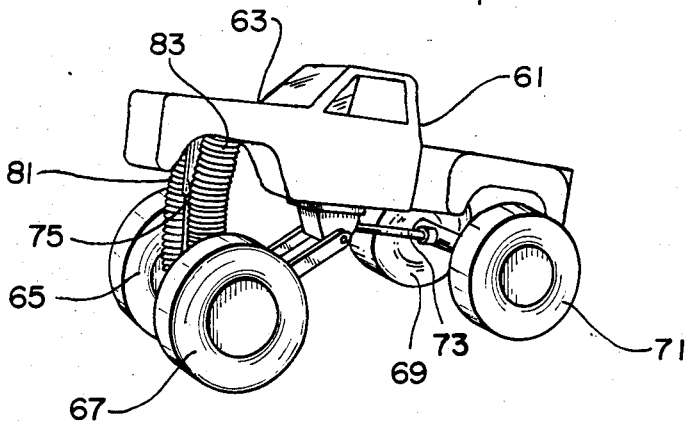
FIG. 6 is a left side view of a second preferred embodiment toy vehicle of the present invention wherein only the front wheels are adjustable and the front axle is connected to the body via a telescopic connection.
Figure 7:
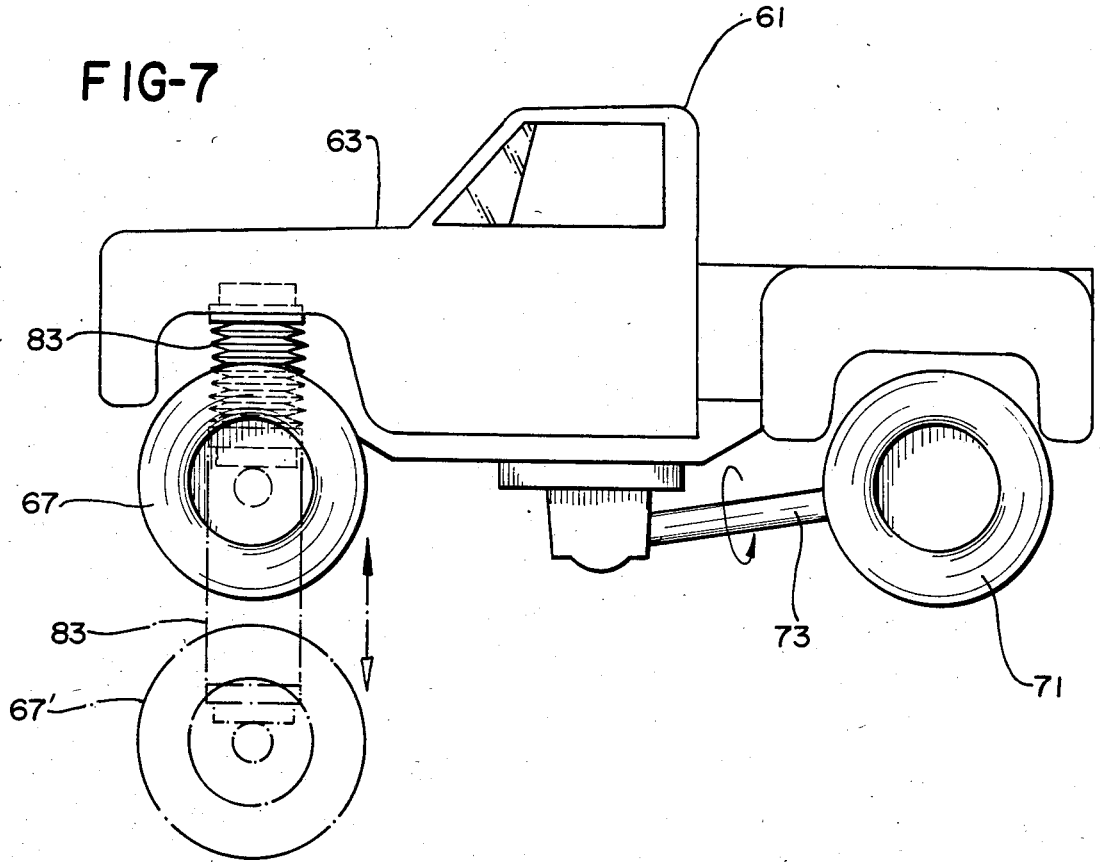
FIG. 7 shows a left side diagram of the toy vehicle of FIG. 6 illustrating the extendability of the front wheels; and, FIG. 8 illustrates the left side view of the toy vehicle shown in FIGS. 6 and 7, but with the left front wheel and left front shock removed and with a partial cut view of the telescopic section which is in the center of the front axle.
Figure 8:
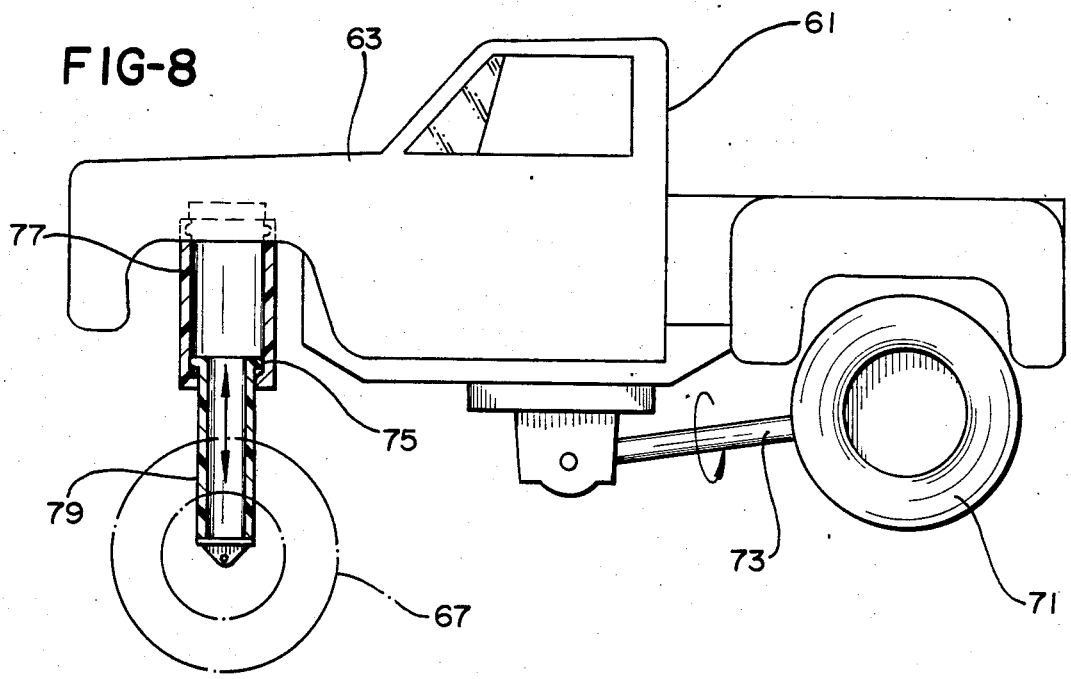

Referring now to FIGS. 6, 7 and 8, another preferred embodiment of the present invention is illustrated generally as toy vehicle 61 having body 63 and having four wheels 65, 67, 69 and 71. In this embodiment, only front wheels 65 and 67 are extendable while rear wheels 69 and 71 are motor driven via a battery operated motor (not shown) and driveshaft 73. Wheel support means 75 is shown at the center of the set of front wheels 65 and 67 and FIG. 8 illustrates a cut section of wheel support means 75 which, in this case, comprises a telescopic vertical wheel support means having a fixed upper portion 77 and a vertically slidable lower portion 79, as shown. Wheel support means 75 is connected to body 63 at its upper portion and connected to the axle of wheels 67 and 69 at its lower portion. The suspension system includes hollow tubes 81 and 83 and these tubes function in the same manner as the hollow tubes described above with respect to FIGS. 1 through 5. FIG. 7 illustrates hollow tube 83 in its open and closed position with wheel 67 in its position closest to body 63 and 67' in its position fully extended therefrom. As in the case of the previously described embodiment, hollow tubes 81 and 83 are connected at their upper portions to body 63 at their lower portions to wheels 65 and 67.

In another embodiment, not shown, it should be clear that the same types of arrangements as shown in the Figures could be utilized for two wheel vehicles such as motorcycles, e.g., with one corrugated snap tube between telescopic shocks of a front wheel, right wheel or both. Likewise, the present invention could be used with a three wheeled vehicle such as a golf cart, lunar vehicle, three wheel all terrain vehicle, or the like. In addition, the arrangements shown could be utilized in trucks or other vehicles having more than four wheels and, could be particularly useful to illustrate military toy vehicles, space toy vehicles, etc. Thus, the present invention applies not only to trucks, but also to cars, farm vehicles, trailers, fire engines, utility vehicles, various types of farming and excavation vehicles, etc. In fact, there is no limit to the imagination with respect to the types of toy vehicles to which the present invention may apply without exceeding its scope.

Obviously, numerous other modifications and variations of the present invention are possible in light of the above teachings. It is therefore understood that, within the scope of the appended claims, the invention may be practiced otherwise than as specifically described herein without exceeding the scope of protection of the claims.

What is claimed is:

1. A toy vehicle, comprising:

(a) a vehicular-type body;

(b) two wheels on a single axis and at least one other wheel;

(c) wheel support means having a movable component with an upper end and a lower end, said movable component of said wheel support means being movably connected to said body at its upper end and being connected to said two wheels on a single axis at its lower end so as to permit movement of said two wheels on a single axis, said movable component being hingedly connected to said body at approximately the center of the underside of said body; and, (d) a suspension system containing at least one hollow tube of thermoplastic material having a flexible zone intermediate the ends thereof, said flexible zone having a plurality of circumferential corrugations extending along its length and having a close-packed position in which they adjoin, the hollow tube being stretchable to sequential lengths until the corrugations assume a longitudinally spaced position, the wall thickness throughout the corrugations being substantially uniform, with said corrugations having side walls, one of which is long and the other of which is short, both of which extend at an acute angle with respect to the axis of said hollow tube, said tube being connected at one end to said body and at the other end to said movable component of said wheel support means.

2. The toy vehicle of claim 1, wherein said movable component is vertically slidably connected to the underside of said body.

3. The toy vehicle of claim 1, wherein said movable component is telescopically connected to the underside of said body.

4. The toy vehicle of claim 1, wherein said toy vehicle is operated manually.

5. The toy vehicle of claim 1, wherein said toy vehicle is a motorized toy vehicle.

6. The toy vehicle of claim 5, wherein the motor is located within said body.

7. The toy vehicle of claim 5, wherein the motor is located on said wheel support means.

8. A toy vehicle, comprising:

(a) a vehicular-type body;

(b) four wheels;

(c) wheel support means having an upper end and a lower end, said wheel support means being movably connected to said body at its upper end and being connected to said wheels at its lower end; and, (d) a suspension system containing four hollow tubes of thermoplastic material having a flexible zone intermediate the ends thereof, said flexible zone having a plurality of circumferential corrugations extending along its length and having a close-packed positon in which they adjoin, the hollow tube being stretchable to sequential lengths until the corrugations assume a longitudinally spaced position, the wall thickness throughout the corrugations being substantially uniform, with said corrugations having side walls, one of which is long and the other of which is short, both of which extend at an acute angle with respect to the axis of said hollow tubes, each of said four tubes being connected at one end to said body and at the other end to said wheel support means for each one of said four wheels.

9. The toy vehicle of claim 8, wherein said wheel support means is made of two components, one of which is connected to the front wheels and one of which is connected to the rear wheels, with each of said two components being independently movable with respect to and connected to said body.

10. The toy vehicle of claim 9, wherein each of said two components is separately hingedly connected to said body at approximately the center of the underside of said body.

11. The toy vehicle of claim 9, wherein each of said two components is vertically slideably connected to the underside of said body.

12. The toy vehicle of claim 9, wherein each of said two components is telescopically connected to the underside of said body.

13. The toy vehicle of claim 8, wherein said toy vehicle is a motorized toy vehicle.

14. The toy vehicle of claim 13, wherein the motor is located within said body.

15. The toy vehicle of claim 13, wherein the motor is located on said wheel support means.

* * * * *